United States Patent [19]

Jonsson

[11] 4,081,037

[45] Mar. 28, 1978

[54] CONTROL SYSTEM FOR A MULTIPLE SPINDLE MACHINE

[75] Inventor: Gregg N. Jonsson, Batavia, Ill.

[73] Assignee: Thor Power Tool Company, Aurora, Ill.

[21] Appl. No.: 654,545

[22] Filed: Feb. 2, 1976

[51] Int. Cl.[2] ..... B25B 23/14

[52] U.S. Cl. ..... 173/1; 173/12

[58] Field of Search ..... 81/52.4 R, 52.4 A, 52.4 B; 173/1, 12; 235/151.11

[56] References Cited

U.S. PATENT DOCUMENTS

| | | | |
|---|---|---|---|
| Re. 28,899 | 7/1976 | Himmelstein et al. | 173/12 |
| 3,693,726 | 9/1972 | Hornig et al. | 173/12 |
| 3,812,744 | 5/1974 | Westerberg | 81/52.4 R |
| 3,926,264 | 12/1975 | Bardwell et al. | 173/12 |
| 3,939,920 | 2/1976 | Hardiman et al. | 173/12 X |
| 3,965,778 | 6/1976 | Aspers et al. | 173/12 X |

FOREIGN PATENT DOCUMENTS

| | | | |
|---|---|---|---|
| 723,036 | 2/1955 | United Kingdom | 81/52.4 |

*Primary Examiner*—Lawrence J. Staab

*Attorney, Agent, or Firm*—Merriam, Marshall & Bicknell

[57] ABSTRACT

This disclosure deals with a machine for simultaneously tightening a plurality of threaded fasteners. The machine includes a plurality of torque applying units, one for each fastener, which engage and torque the fasteners. Each unit includes a spindle which engages the fastener and a torque sensing circuit which generates a torque signal representing the magnitude of the torque being applied. A torque control circuit of each unit prevents torquing to above a preset upper limit. A central control circuit receives the torque signals from all of the units, makes a comparison of torque values to identify any unit where the applied torque is greater than that of the other unit or units, and prevents such an identified unit from continuing to apply torque until the other unit or units applies torque essentially equal to that of the identified unit. The torque signals from the units may be averaged and the torque signal of each unit compared with the average. If only two units are provided, one torque signal may be compared with the other torque signal.

31 Claims, 9 Drawing Figures

CONTROL SYSTEM FOR A MULTIPLE SPINDLE MACHINE

Torque applying tools are well known and are widely used in industry. For example, electrically powered and air powered nutsetters and screwdrivers are used in the assembly of automobile and truck parts. While such a tool may be turned on and off by an operator of the tool, in recent years automatic control systems have been developed for this purpose. U.S. Pat. No. 3,926,264, issued Dec. 19, 1975 to F. G. Bardwell and E. C. Dudek, and entitled "Control Circuit For a Power Tool" discloses such a system where an operator turns a tool on and the control system automatically turns the tool off when the applied torque reaches a preset level.

Machines have also been provided including a number of torque applying tools for simultaneously tightening a number of fasteners. Such a machine may be used, for example, to simultaneously turn a number of bolts used to fasten the head to the block of an automobile engine. Machines of this character are commonly known as multiple nutsetters.

Multiple tool machines provided in the past have been deficient in that the fasteners may not be torqued at the time and to the same degree. In the above example regarding the assembly of an automobile engine, one bolt may turn more easily than the others, resulting in that bolt being tightened ahead of the others. This can result in the parts not seating properly and in damage to the gasket between the block and the head. Further, in the situation where one bolt is tightened ahead of the others, the first bolt may loosen slightly after the other bolts have become tightened.

It is a general object of the present invention to overcome the foregoing problems by providing a machine including a plurality of torque applying units, and a central torque control system for uniformly tightening a plurality of fasteners.

A machine in accordance with the present invention comprises a plurality of torque applying units, each of said units including a spindle, drive motor means connected to said spindle, torque sensing means associated with said spindle for providing a torque signal representative of the torque output of said spindle, and torque control circuit means connected to receive said torque signal and connected to control energization of said drive motor for deenergizing said drive motor when said torque as represented by said torque signal reaches a preset value, said machine further including central control circuit means connected to receive said torque signal from each of said units, said central control circuit means comprising comparator means for comparing said torque signal of each unit with a comparison signal. When said torque signal of a particular unit is higher than said comparison signal, said central control circuit provides an inhibit signal which turns off said particular unit.

In a machine including only two units, the torque signal of each unit may be compared with the torque signal of the other unit. Thus, the comparison signal would comprise one of the torque signals.

In a machine including two or more units, the torque signals may be combined to provide a comparison signal which is a function of the average of all of the torque signals.

The central control system may further include a suppressor circuit which disables the central control system from inhibiting the units, until a minimum applied torque level is reached by all of the units. The suppressor circuit may also disable the central control circuit after an upper torque level is reached.

The foregoing and other objects and advantages of the present invention will become more apparent from the following detailed description taken in conjunction with the accompanying figures of the drawings, wherein.

While the invention described herein has utility in other fields, it is particularly useful in a machine for simultaneously tightening a plurality of fasteners. The system illustrated and described herein is designed to control a multiple spindle nutsetting machine, but it should be understood that the illustrated construction is by way of a specific example only.

Figure 1:
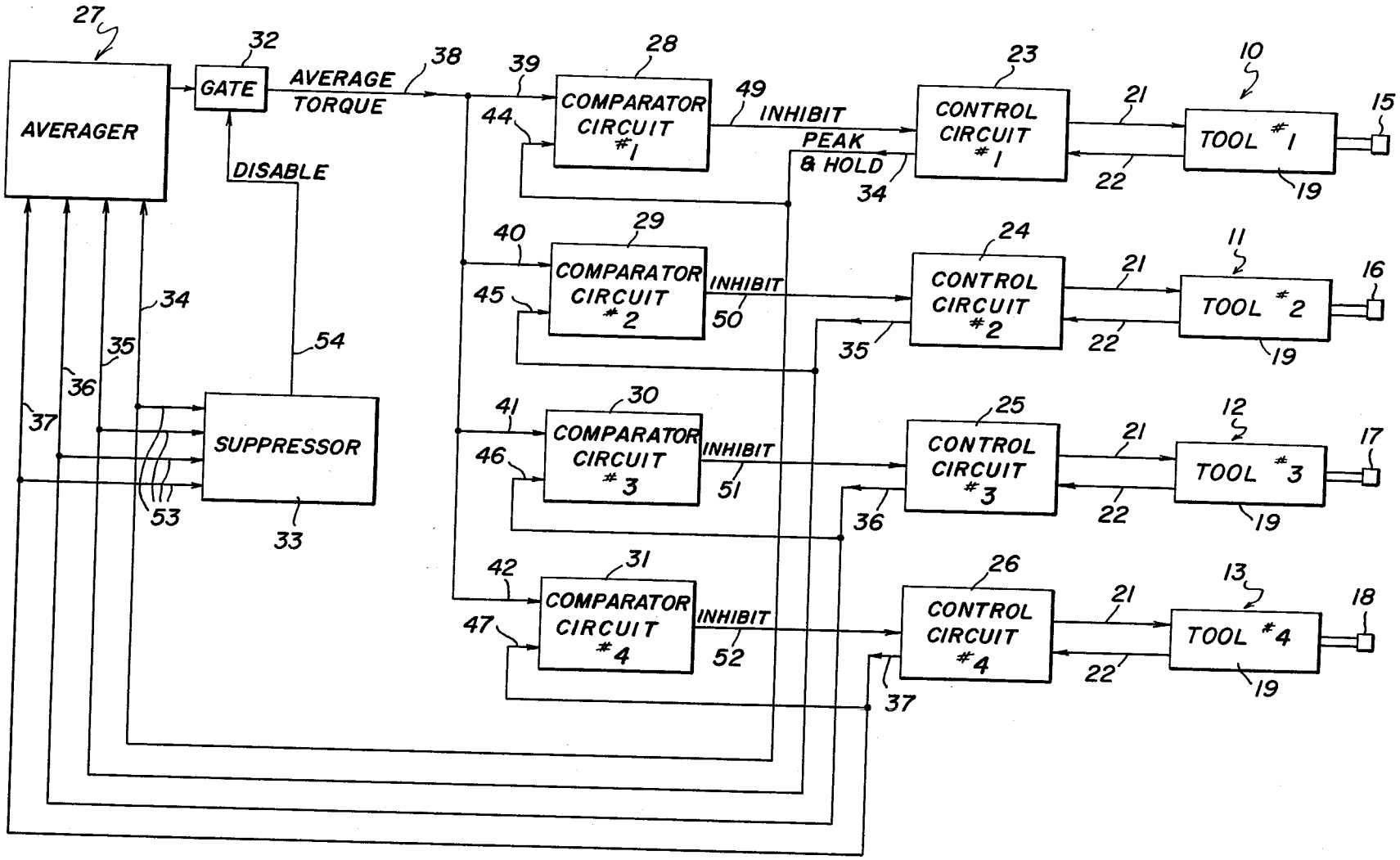
FIG. 1 is a block diagram of a system embodying the invention.

The apparatus illustrated in FIG. 1 comprises four tools 10, 11, 12 and 13, the tools including spindle 15 through 18, respectively. The spindles 15 through 18 may be designed to drive fasteners (not shown) such as nuts or screws. Each tool includes a housing 19 for a drive motor for the associated spindle, the drive motor being, for example, air powered or electrically powered. Power supplies for the drive motor are not illustrated but would of course have to be provided.

As described in detail in the previously mentioned Bardwell et al patent, each tool 10 through 13 further includes a solenoid actuated air valve, in the case where the spindle is powered by an air motor, the air valve being located in the housing 19. The solenoid of each tool is energized by a control signal which appears on an input line 21 to each of the four tools. When a control signal appears on each line 21, the solenoid is energized and the air valve opens to admit compressed air to the drive motor and thereby drive the spindle of the unit. Of course, when the solenoid is not energized, the spindle is not driven.

As is also described in the Bardwell patent, each tool further includes, in the housing 19, a torque sensing circuit which may, for example, consist of a bridge-connected strain gauge arrangement. The torque sensing circuit generates a torque signal which appears on a line 22 leading from each of the four tools, the amplitude of the voltage on each line 22 being representative of the magnitude of the torque output of the associated spindle.

Associated with the tools 10 through 13 are control circuits 23 through 26, respectively. The control circuits 23 to 26 generate the control signals on the lines 21, and the control circuits receive the torque signals on the lines 22 which are provided by the torque sensing circuits of the tools. Each control circuit 23 to 26 and the associated tools 10 to 13 is referred to herein as a torque applying unit.

In the preferred form of the control circuit described in the previously mentioned Bardwell et al patent and in the construction described herein, the control circuits 23 through 26 are designed to turn the tools 10 to 13 on and off as the spindles apply torque to the fasteners. The units operate in a pulsating mode of operation and the torque signals appearing on the lines 22 consist of trains of voltage pulses, the peak or maximum value of each of the pulses representing the amount of torque being applied. The amplitudes of the torque pulses gradually increase as the amount of torque being applied by the spindles increases.

As previously mentioned, it is advantageous to have the four tools 10 through 13 operate simultaneously and uniformly so that the maximum desired torque value is reached by all of the units at the same time. This is accomplished by a central control circuit including an averager circuit 27, four comparator circuits 28 through 31, a suppressor circuit 33, and a component 32 which performs a number of functions but is referred to herein as a gate. The four control circuits 23 through 26 generate peak torque signals which appear on output lines 34 through 37, and these four outputs are connected to four inputs of the averager circuit 27. The signals on the lines 34 to 37 are represented by the curves 60 to 63 in FIG. 2, which are plots of voltage amplitude vs. time. The circuit 27 receives the four peak torque signals and provides an average torque signal on an output line 38 which is fed to inputs 39 through 42 of the four comparator circuits 28 through 31, respectively. The average torque signal on the line 38 is represented by the curve 72 in FIG. 2, which is also a plot of voltage vs. time. The four comparator circuits 28 through 31 include second inputs 44 through 47, respectively, which are connected to receive the four peak torque signals appearing on the lines 34 through 37, respectively. The outputs of the four comparator circuits 28 through 31 appear on lines 49 to 52 which are connected between the comparator circuits and inputs of the associated control circuits 23 to 26, respectively.

The previously mentioned suppressor circuit 33 includes four inputs 53 which are connected to the lines 34 through 37, so that the suppressor circuit 33 receives the four peak torque signals, and the output 54 of the suppressor 33 is connected to a control input of a gate 32 which is connected between the averager circuit 27 and the inputs of the four comparator circuits 28 through 31. The purpose of the suppressor circuit 33 is to generate a disabling or suppressor signal, represented by the signal 78 in FIG. 2, which disables the central control circuit until the four peak torque signals have reached a preset minimum level.

As previously mentioned, the term unit is used to designate one of the four tools 10 to 13 and the associated control circuit 23 to 26. The term central control circuit is used to refer to the four comparator circuits 28 to 31, the averager circuit 29 and the gate 32, and the suppressor circuit 54. While the four tools 10 through 13 may be mounted on a single frame, this is not necessary since they may be mounted and handled separately.

The operation of the system illustrated in FIG. 1 will be described further in connection with the timing diagram shown in FIG. 2, wherein all of the curves are plots of voltage vs. time. The curves indicated by the numerals 60 through 63 represent the peak torque signals appearing on the lines 34 through 37, respectively. With specific reference to the curve 60, the portion 66 represents the torque output when the tool is first turned on and the tool spindle 15 starts to turn the fastener, this torque being the result of friction as the parts start to move. The portion 67 indicates the torque being applied while the fastener is being run up before any tightening takes place. The stepped portion of the curve including horizontal sections 68 and sloped sections 69 represents the peak torque while the fastener is being tightened, and the portion 70 indicates the preset torque level at which the control circuit 23 automatically turns off the tool 10. The other three curves 61 through 63 are, of course, similar to the curve 60. The shape of the horizontal sections 68 and the sloped sections 69 is due to the fact that the tool is repetitively turned on and off, or pulsed, by the unit control circuit 23 as the fastener is being tightened. A memory circuit holds the previously existing peak torque level when the tool is off, as will be explained hereinafter.

The four signals represented by the curves 60 through 63 are fed to the averager circuit 27 as previously explained, and the averager circuit 27 produces the curve 72 which is a function of the mean or average torque of the four units. During the operation of the system, the comparator circuit 28, for example, receives the signals on the lines 39 and 44, represented by the curves 72 and 60, respectively, compares the voltage magnitudes of the two signals 72 and 60, and produces an inhibit signal on the line 49 only when the magnitude of the curve 60 exceeds the magnitude of the curve 72 at any particular instant. In the example illustrated in FIG. 2, an inhibit signal 73 is generated at an instant when the peak value of the curve 60 slightly exceeds that of the curve 72, and the inhibit signal 73 is fed to the control circuit 23 by the line 49. As will be described hereinafter, the control circuit 23 is inhibited from turning on the tool 10 during the time that the inhibit signal 73 exists. Consequently, the peak value of the torque curve 60 does not increase during the presence of the inhibit signal 73, but at least some of the other tools 11 to 13 remain on during this period of time. Consequently the other three peak torque curves 61 through 63 increase and cause an increase in the average torque curve 72. When the average torque curve 72 rises to the point where the peak torque curve 60 is no longer greater than the average torque curve 72, the inhibit signal 73 is withdrawn from the line 49 and the control circuit 23 is once again able to turn on the tool 10.

Figure 2:
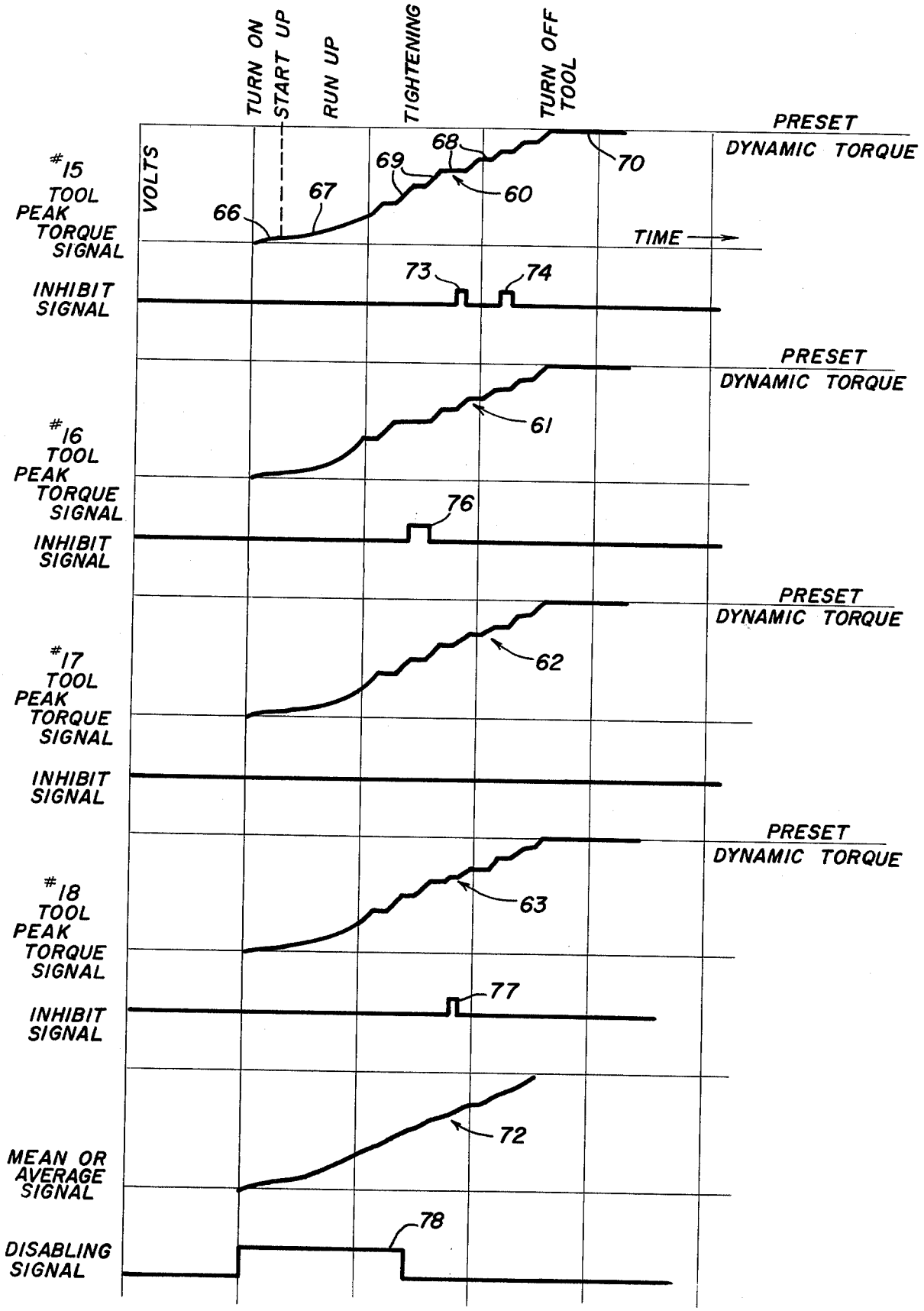
FIG. 2 is a timing diagram illustrating the operation of the system.

In the example illustrated in FIG. 2 and discussed above, the tool 10 is a relatively fast operating tool and it is necessary for two inhibit signals 73 and 74 to be generated in order to prevent the tool 10 from going too far ahead of the other tools. The two tools 11 and 13 are momentarily stopped only at one time each by inhibit signals 76 and 77, whereas the tool 12 is relatively slow in operation and no inhibit signals are generated for this unit.

As previously mentioned, it is desirable that no inhibit signals be generated until the torque being applied by each of the spindles reaches a predetermined magnitude, and this function is accomplished by operation of the suppressor circuit 33 and the gate 32. As will be described hereinafter, the suppressor circuit 33 responds to the four peak torque signals and generates a disabling or suppressor signal 78 (FIG. 2) which is fed to the gate 32. The signal 78 is generated when the peak torque signals 60 to 63 are less than a preset minimum level. In the presence of the disabling signal 78, the gate 32 is closed and the average torque signal 72 is prevented from being fed to the four comparator circuits 28 through 31. However, when the torque output of the four spindles, as represented by the four peak torque curves 60 through 63, all reach the preset minimum level or magnitude, the disabling signal 78 is terminated and the gate 55 is opened, thereby enabling operation of the system as previously explained.

Thus, the system operates by sensing the amount of torque being provided by each of the units, generating a signal representing the average of the torque outputs of the units, comparing the torque output from each unit with the average torque, and preventing the operation of a unit which is operating ahead of slower units until the slower units catch up to the faster unit. Consequently, the four tools will tighten their fasteners simultaneously and with uniformly applied torque until the preset maximum desired torque level 70 is reached at which time the four tools are automatically turned off.

Figure 3A:
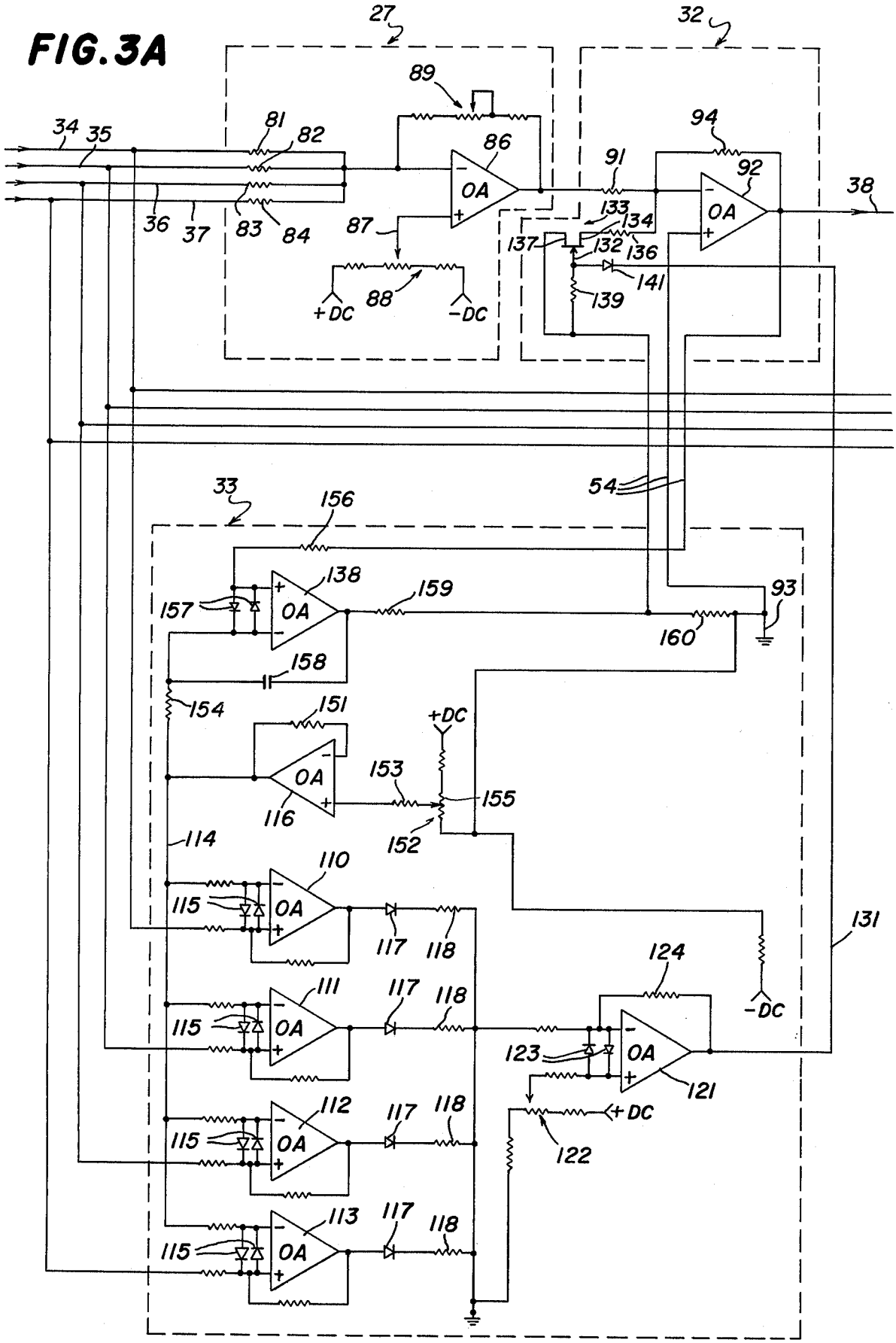
FIGS. 3A and 3B are schematic electrical diagrams of a part of the system of FIG. 1.
Figure 3B:
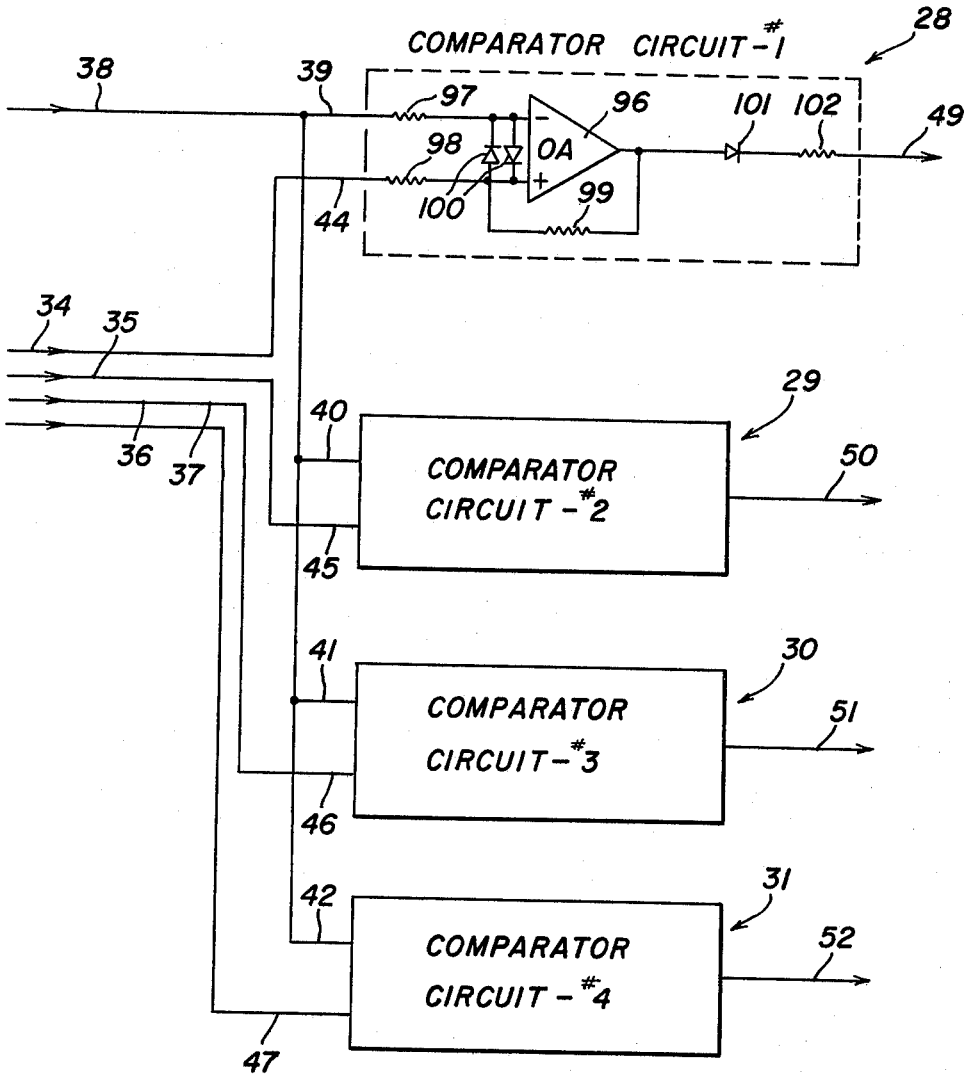

The constructions of the averager circuit 27, the four comparator circuits 28 through 31, the gate circuit 32 and the suppressor circuit 33 are illustrated in FIGS. 3A and 3B. The averager circuit 27 includes four resistors 81 through 84 which have one side connected to receive the peak torque signals on the lines 34 through 37, respectively. The other sides of the four resistors 81 through 84 are all connected to the negative input of an operational amplifier 86 which is connected in the form of a summing or adding circuit. The positive input of the amplifier 86 is connected to the wiper 87 of a potentiometer which is connected in a resistance network 88. The resistance network 88 is connected across a DC power supply, such as plus and minus 15 volts, and, of course, a DC potential appears at the positive input of the amplifier 86 which is a reference voltage level. The output of the amplifier 86 is connected through an adjustable resistance network 89 to its negative input to form a resistance feedback loop.

If the symbol $R_f$ represents the total resistance in the feedback resistance network 89, the symbol $R_n$ equals the resistance of any one of the four resistors 81 through 84, each of these resistors being equal, $E_o$ equals the voltage at the output of the amplifier 86, $E_1$, $E_2$, $E_3$ and $E_4$ respectively represent the voltages on the lines 34 through 37, then $$E_o = -R_f/R_n(E_1 + E_2 + E_3 + E_4) \quad \ldots (1)$$

If $R_f$ is adjusted to be equal to $R_{n/N}$, where N is the number of input signals, then $$R_f = R_{n/4} \quad \ldots (2)$$

$$E_o = -R_{n/4}/R_n(E_1 + E_2 + E_3 + E_4) \quad \ldots (3)$$

$$E_o = -\tfrac{1}{4}(E_1 + E_2 + E_3 + E_4) \quad \ldots (4)$$

From equation 4 it will be apparent that the voltage amplitude output $E_o$ of the amplifier 86 is equal to one-fourth of the sum of the four input voltages. In other words, $E_o$ is equal to the average of the four input voltage signals on the lines 34 to 37.

The advantage of providing a variable resistor in the resistance network 88 is so that the output signal of the amplifier 86 may be made to have a constant error which is either slightly higher or lower than the true average torque, or the resistance may be adjusted to produce an output signal which is exactly equal to the average of the torque.

It will also be apparent from equation (4) that the voltage at the output of the operational amplifier 86 is negative. This voltage is connected through a resistor 91 to the negative input of an operational amplifier 92 which operates as a buffer amplifier, an inverter and, in certain circumstances as will be explained hereinafter, as a gate. The positive input of the amplifier 92 is connected to a signal reference or ground 93, and the output of the amplifier 92 is connected through a feedback resistor 94 to the negative input. The output of the amplifier 92 is also connected to the line 38 which leads to the comparator circuits 28 to 31. Since the amplifier 92 inverts the signal out of the amplifier 86, a positive going or increasing voltage will appear on the line 38, represented by the curve 72 and having a magnitude which is a function of the average of the four peak torque signals 60 to 63.

The four comparator circuits 28 to 31 (FIG. 3B) are identical and therefore only one will be described in detail. The comparator circuit 28 includes an operational amplifier 96 which is connected as a voltage comparator circuit. The input 39 is connected to line 38 and to the negative input of the amplifier 96 through a resistor 97, and the line 44 is connected to the positive input of the amplifier 96 through another resistor 98. Another resistor 99 is connected in a feedback loop between the output of the amplifier 96 and its positive input. The purpose of the feedback loop will be described hereinafter. A diode 101 and a resistor 102 are connected between the output of the amplifier 96 and the line 49 which leads to the control circuit 23. Two back-to-back diodes 100 are connected across the two inputs of the amplifier 96, the purpose being to protect the amplifier against damage due to high transient voltage peaks on the inputs.

Considering the average signal 72 on the negative input of the amplifier 96 to be the reference value and neglecting for the moment the effect of the resistor 99 feedback loop, the output of the amplifier 96 will be positive whenever the voltage on the positive input is higher than the voltage on the negative input. Since the peak torque signal appears at the positive input and the average torque signal appears at the negative input, it will be apparent that the output of the amplifier 96 will be positive whenever the peak torque value is greater than the average torque value. Such a positive signal at the output of the amplifier 96 comprises the previously mentioned inhibit signal. The anode of the diode 101 is connected to the amplifier 96 output, and therefore a positive voltage output biases on the diode 101 and the positive voltage signal passes to a line 49 which leads to a power switch as will be described hereinafter.

The purpose of the feedback loop including the resistor 99, which may be referred to as a hysteresis resistor, is to provide a voltage band in which the circuit 28 operates. This prevents the amplifier 96 from switching from one state to the other with very little variation in the voltage on the line 44. The amplifier 96 will switch and its output will fall or become negative when the voltage on the line 39 is higher than the voltage on the line 44 plus the feedback voltage through the resistor 99. Conversely, the amplifier 96 will switch and its output will rise or become positive when the voltage on the input 39 is below the voltage on the input 44 minus the feedback voltage through the resistor 99. The width of the band within which the amplifier 96 operates or switches is proportional to the ratio of the resistor 99 to the resistor 98, and the amplifier 96 will switch on opposite sides of the reference voltage level appearing on the line 39. Of course, the reference voltage appearing on the line 39 is not a constant value but is gradually increasing since the average torque increases, as indicated by the curve 72 in FIG. 2.

As previously mentioned, the construction of the other three comparator circuits 29, 30 and 31 is identical with the construction of the comparator circuit 28. The outputs of the four comparator circuits are connected by the lines 49 to 52 to the associated unit control circuits 23 to 26. In each case, the comparator circuit compares the peak torque voltage of the associated unit with the average torque voltage, and generates a positive inhibit signal in the event that the peak torque signal voltage minus the feedback voltage is higher than the average torque signal voltage. When a peak torque signal voltage plus the feedback voltage falls below the average torque signal voltage, an inhibit signal no longer appear.

As mentioned previously, the averaging circuit 27 includes a variable resistor in the resistance network 88 which permits an adjustment of the reference voltage level on the positive input. Such an adjustment has the effect of varying the voltage level of the output signal of the amplifier 88, and the torque signal 72 may be made slightly higher or lower than the actual average torque or exactly equal to the actual average torque. If the resistance network 88 is adjusted to make the signal 72 slightly higher than the actual average torque, then the peak torque signals 60 to 63 will have to reach a higher level before the voltage comparator circuits will generate inhibit signals. The result would be that a larger number of units would likely be operating at any given time. If the signal 72 were made less than the actual average torque, a larger number of units would likely be turned off at any given time. The resistance network 88 may therefore be adjusted to obtain any desired operating characteristics.

The suppressor circuit 33 includes four operational amplifiers 110, 111, 112 and 113 which are connected as voltage comparators. The positive inputs of the four amplifiers 110 through 113 are respectively connected to receive the peak torque signals on the lines 34 through 37. The negative inputs of the four amplifiers are all connected to a line 114 which receives an adjustable preset torque reference voltage level from the output of an operational amplifier 116. Assuming that the voltage on the line 114 is set and held at a constant level, the output of each of the amplifiers 110 through 113 will be negative, or low, when the peak torque voltages on the lines 34 through 37 are lower than the reference voltage level on the line 114. On the other hand, when a peak torque voltage rises to a level which is above the reference voltage level on the line 114, the associated amplifier will switch and the output of the amplifier will become high or positive. Back-to-back diodes 115 are connected across the inputs of the amplifiers 110 to 113 to protect the amplifiers as previously explained.

The outputs of the operational amplifiers 110 through 113 are connected through diodes 117 and resistors 118 to the negative input of another operational amplifier 121 which is connected as a NAND gate. The positive input of the amplifier 121 is connected to the wiper of a variable resistor of a resistance network 122 which is connected between a positive DC supply, such as 15 volts, and ground. The positive and negative inputs of the amplifier 121 are also connected by two back-to-back diodes 123 which ensure that the difference in voltage levels between its two inputs will not be greater than approximately one volt. The amplifier 121 also has its output connected to its negative input through a feedback resistor 124.

The operational amplifier 121 is thus connected as a NAND gate, the operation being such that if one or more of its four input signals is negative, then the output of the amplifier 121 will be positive. When all of the inputs to the amplifier 121 are positive, then the output will be negative.

At the beginning of operation of the system being described herein, the signals appearing on the lines 34, 35, 36 and 37 will be low because, at initial startup, the amount of torque being applied is relatively low. As a specific example, if the maximum voltage producible by the torque transducers in the tools 10 to 13 is plus 5 volts, the voltages on the lines 34 to 37 at startup will be less than one volt. If the reference voltage on the line 114 is set at plus 2 volts, the voltage levels at the positive inputs of the four amplifiers 110 through 113 will be lower than the voltage at the negative inputs of the amplifiers, and consequently the outputs of the four amplifiers 110 through 113 will be negative. As the tools continue to operate, the peak torque voltages on the lines 34 to 37 will gradually rise as indicated by the curves 60 through 63 in FIG. 2. As the peak torque voltages rise to above the reference voltage level on the line 114, the amplifiers 110 to 113 switch and their outputs become positive. When the fourth of the amplifiers 110 through 113 switches and its output becomes positive, the amplifier 121 will also switch and its output will become negative.

The existence of a positive signal on a line 131 connected to the output of the amplifier 121 is considered a disabling or suppressor signal which is indicated by the reference numeral 78 in FIG. 2. The disabling signal 78 is absent when the output of the amplifier 121 is negative.

It was previously mentioned that the component 55 also serves as a gate for controlling the flow of the signal from the averaging circuit 27 to the four comparator circuits 28 through 31. The signal appearing at the output of the amplifier 121 controls the operation of this gate. The output of the amplifier 121 is connected by the line 131 to the gate 132 of a field effect transistor (FET) 133. The drain 134 of the transistor 133 is connected through a resistor 136 to the negative input of the amplifier 92, and the source 137 of the transistor 133 is connected to the output of an operational amplifier 138 by one of the lines 54. The source 137 is also connected to the gate 132 through a resistor 139. A diode 141 connects the gate 132 to the line 131 which leads to the output of the amplifier 121.

The transistor 133 is an n-channel junction field effect transistor, as previously mentioned. When the potential across its source-gate terminals is zero, the transistor 133 is biased on, and little resistance is presented between its source and drain terminals. Consequently, the output of the operational amplifier 138 will be connected through a resistor 159 and the resistor 136 to the negative input of the amplifier 92. If the gate 132 of the transistor 133 is negative relative to the source, the transistor 133 is biased off and the amplifier 92 will be effectively disconnected from the amplifier 138.

As previously mentioned, the reference voltage appearing on the line 114 is produced by the operational amplifier 116. The negative input of the amplifier 116 is connected by a feedback loop through a resistor 151 to its output, and the positive input of the amplifier 116 is connected to a resistance network 152 which is connected across a positive and negative DC supply, such as plus and minus 15 volts. The positive input is connected through a resistor 153 to the wiper of a potentiometer 155 which permits an adjustment of the potential at the positive input in order to vary the potential at the output of the amplifier 116 and on the line 114. In the case where the voltages on the lines 34 to 37 vary between 0 and plus 5 volts, the reference voltage on the line 114 may be adjusted to approximately 1 to 2 volts positive.

The reference voltage level on the line 114 is also connected through a resistor 154 to the negative input of the amplifier 138 which is connected in the form of a voltage follower-invertor. The positive input of the amplifier 138 is connected in a feedback loop which includes a resistor 156, amplifier 92, FET 133, and the resistors 136 and 159. The positive and negative inputs of the amplifier 138 are also connected together through back-to-back diodes 157 which maintain the voltage levels between the two inputs at less than one volt. The output of the amplifier 138 is also connected to its negative input through a capacitor 158, and the output of the amplifier 138 is also connected through the resistor 159 and another resistor 160 to the ground potential 93.

Considering the operation of the suppressor circuit 33 and the gate circuit 32, assume that the system has just been turned on and the peak torque signals on the lines 34 through 37 are all at close to zero volts. The output of the amplifier 121 will therefore be high or positive, as previously mentioned, and this high output represents a disabling or suppressor signal on the line 131. Due to the positive signal on the line 131, the diode 141 is reversed biased and does not conduct, and consequently the potential on the gate 132 is substantially equal to the potential on the source 137. The transistor 133 is, therefore, biased on and the negative input of the amplifier 92 is connected to the output of the amplifier 138. With the transistor 133 biased on, the amplifier 92 is connected in feedback loop of the amplifier 138. Due to the inversion by the amplifier 138, the positive voltage on the line 114 will appear as a negative voltage at the amplifier 138 output which is connected to the negative input of the amplifier 92. The output of the amplifier 92, and the line 38, will be driven positive to a level where the two inputs of amplifier 138 are equal, which is the reference level on the line 114. As previously mentioned, the reference voltage level on the line 114 is considerably higher than the peak torque signals 60 to 63 at startup, and is determined by the setting of the potentiometer 155. With a relatively high voltage value on the line 38, the negative inputs of the four comparator circuit amplifiers 96 will also be at a high value and they will be higher than the peak torque signals at the positive inputs of these amplifiers 96. The outputs of the comparator circuits 28 through 31 will, therefore, all be at low values, which represents the absence of inhibit signals, and the four control circuits 23 through 26 will turn the tools 10 through 13 on and off in a pulsating mode and tighten the fasteners.

When the amount of torque being applied to each fastener and the peak torque signals rise to a sufficiently high value the amplifier 121 of the suppressor circuit 33 will switch and its output will become low. The low signal appearing on the line 131 will cause a negative pulse to appear across the resistor 139, the diode 141 of course being biased on. This negative pulse biases the transistor 133 off and the input of the amplifier 92 is disconnected from the output of the amplifier 138. The negative input of the amplifier 92 is however still connected to the output of the amplifier 86 which becomes controlling and represents the average value of the peak torque signals as previously explained. It will be apparent therefore that a low signal on the line 131, which is in effect the absence of a suppressor or disabling signal, turns on the gate 55 and enables the average torque signal to pass to the four comparator circuits 28 through 31, and the system then operates as previously explained until the tools 10 through 13 are turned off by operation of the control circuits 23 through 26.

The previously mentioned Bardwell et al U.S. Pat. No. 3,926,264 discloses a number of control circuits for a tool, including a circuit which operates the tool in a pulsating mode. While other of the circuits may be used in the system of the present invention, the circuit which operates in a pulsating mode is preferred and disclosed in detail herein.

Figure 4:
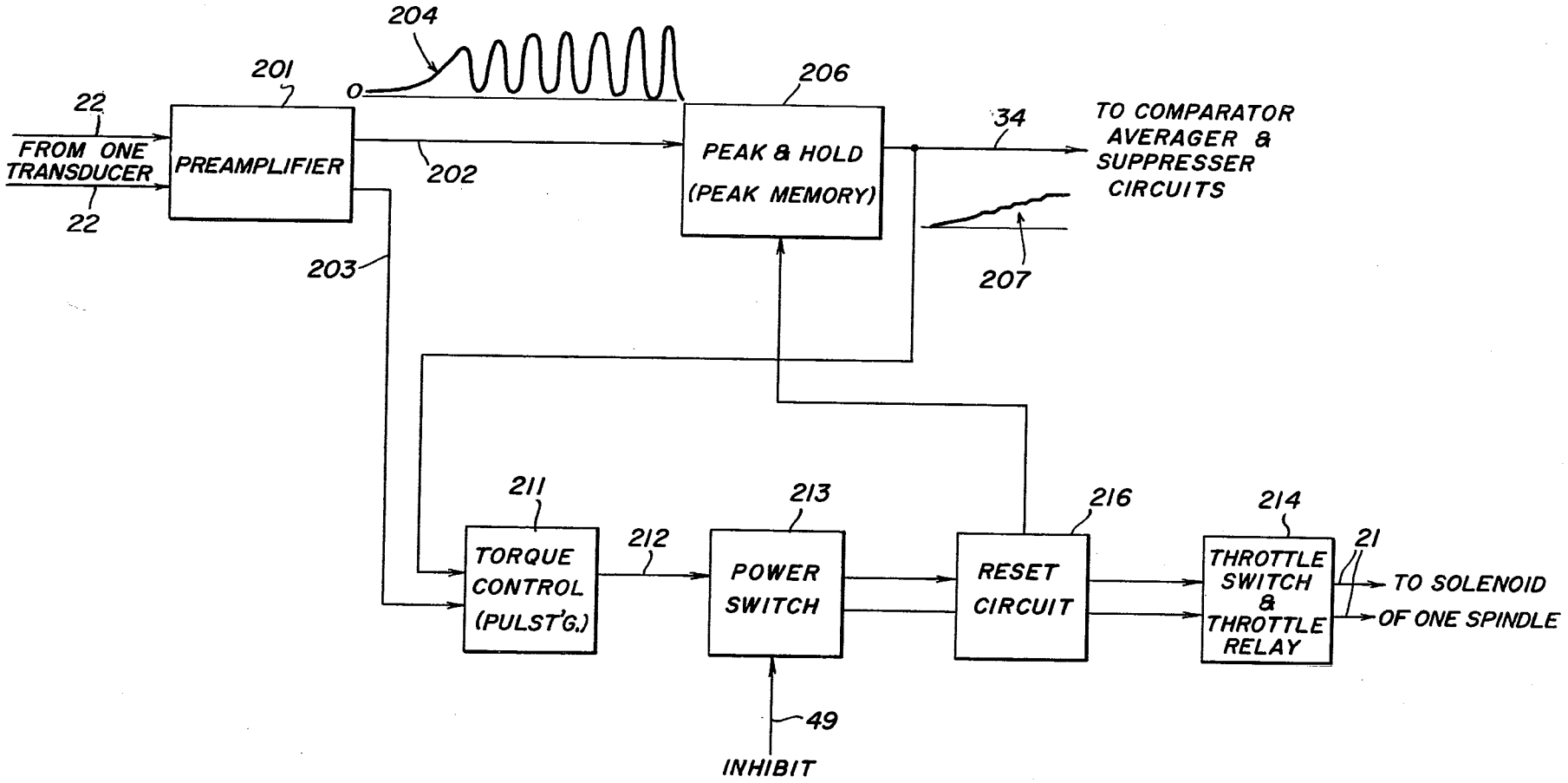
FIG. 4 is a block diagram of a part of the system illustrated in FIG. 1.
Figure 5A:
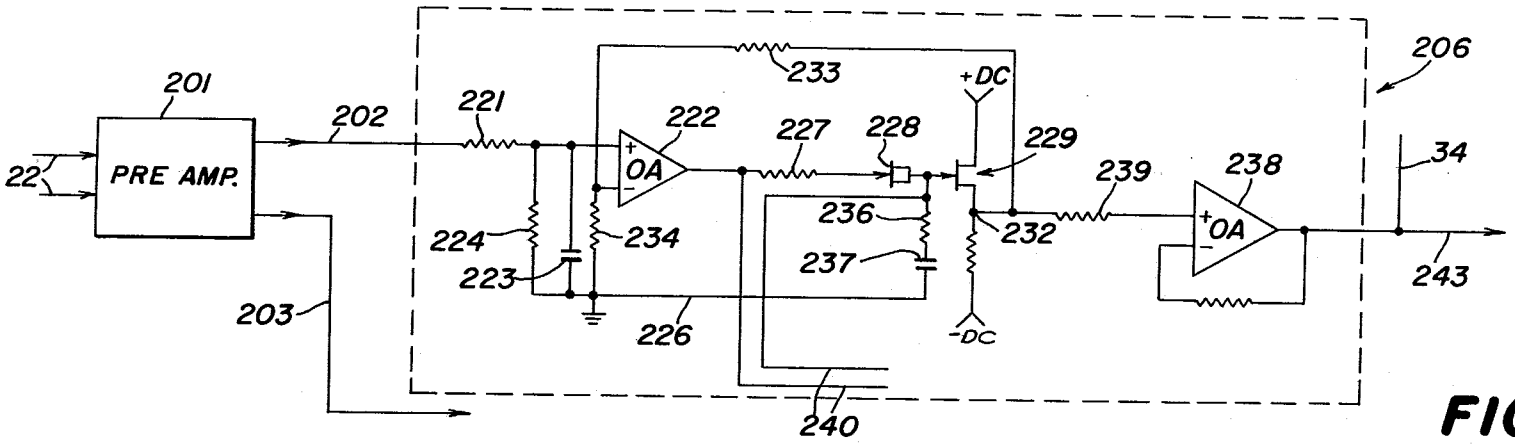
FIGS. 5A and 5B are schematic electrical diagrams of parts of the structure shown in FIG. 4.
Figure 5B:
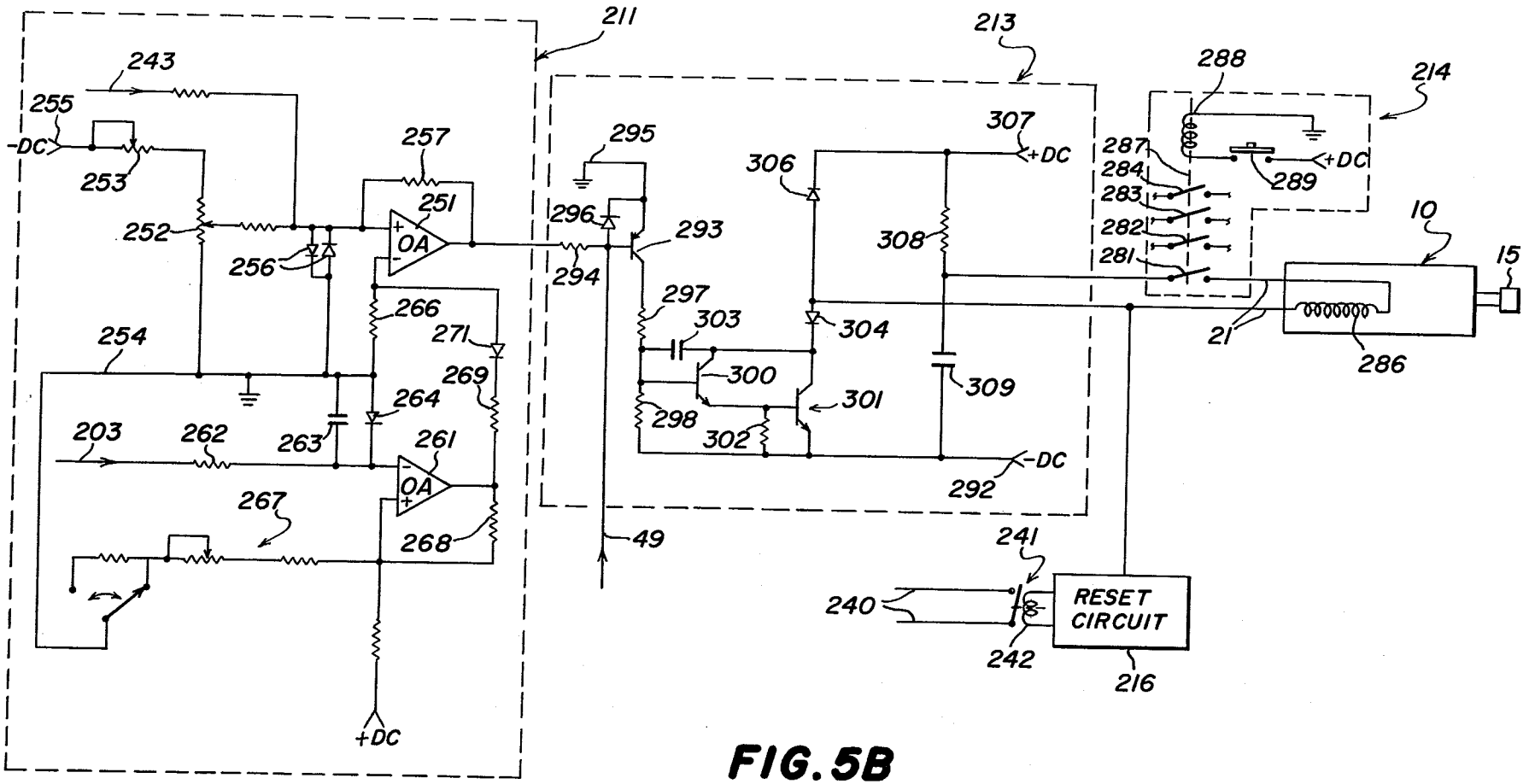

FIG. 4 is a block diagram and FIGS. 5A and 5B are schematic electrical diagrams of one of the four control circuits 23 through 26, such as the circuit 23. The construction and operation of such a control circuit is also described in the previously mentioned Bardwell et al patent.

With reference first to the block diagram of FIG. 4, the control circuit 23 includes a preamplifier 201, which may have a conventional construction, that receives the torque signals on the line 22 from the torque sensing circuit in the tool 10. The preamplifier 201 has two outputs 202 and 203, both of which consist of a pulsating, positive voltage signal 204, the amplitude of the pulses representing the amount of torque being applied by the tool 10. The output signal 204 on the lines 202 and 203 consists of a train of voltage pulses which gradually increase in amplitude as the torque output of the tool 10 increases.

The preamplifier output 202 is fed to a peak and hold, or memory, circuit 206 which produces a signal 207 on the line 34 which represents the peak value of the most recently received pulse of the signal 204. The peak torque signal 207 is indicated by the numeral 60 in FIG. 2. The slanted portions of the signal 207 coincide with the pulses of the signal 204, and the horizontal portions of the signal 207 represent the time periods between the pulses of the signal 204. The output line 34 is connected to the input of the averager circuit 27, the suppressor circuit 33, and the comparator circuits 28 through 31, as previously mentioned, and the output of the circuit 206 is also connected to an input of a torque control circuit 211 which has a second input connected to the line 203. Thus, the torque control circuit 211 receives two input signals, one being the torque pulses indicated by the reference numeral 204 and the other being the peak torque signal indicated by the numeral 207. As will be described in connection with FIGS. 5A and 5B, the torque control circuit 211 produces an output signal on a line 212 which repetitively opens and closes a power switch 213. The power switch 213 in turn controls energization of the solenoid of the air valve in the tool 10. A reset circuit 216 is also connected to the output of the power switch 213 and resets the peak and hold circuit 206 between cycles of operation, such resetting resulting in the voltage on the output 34 being reduced to a zero or reference level. The reset circuit 216 may have a conventional construction which is designed to reset the peak and hold circuit 206 either at the end of a cycle of operation of the system or at the beginning of the next succeeding cycle, the latter being preferred. The line 49 for the inhibit signals is connected to the power switch 213. A manually operable throttle switch and relay 214 is connected between the switch 213 and the solenoid of the air valve.

With reference first to the construction of the peak and hold circuit 206 illustrated in FIG. 5A, the output 202 of the preamplifier 201 is connected through a resistor 221 to the positive input of an operational amplifier 222. A filter capacitor 223 and a resistor 224 connect the positive input of the amplifier 222 to a reference or ground line 226, the capacitor 223 being provided to filter out any high frequency spikes which may occur in the torque pulses on the line 202 due, for example, to static friction. The output of the amplifier 222 is connected through a resistor 227 and a diode 228 to the gate of a FET 229. The diode 228 is preferably a FET connected as a diode, this arrangement being preferred because of the extremely low current leakage characteristic of this component. The drain of the transistor 229 is connected to a positive DC source such as 15 volts and the source is connected through a resistor 231 to a negative DC source such as 15 volts. When the transistor 229 is biased on, the potential at the junction 232 between the transistor 229 and the resistor 231, will be a function of the values of the two DC sources, the value of the resistance 231 and the resistance of the transistor 229. This junction 232 is connected by a feedback loop including a resistor 233 to the negative input of the amplifier 222. This negative input is also connected by a resistor 234 to the ground or reference line 226. The gate of the transistor 229 is also connected by a resistor 236 and a capacitor 237 to the ground line 226.

Considering the operation of the portion of the circuit 206 described thus far, assume that a positive pulse appears on the line 202. Any spikes on the pulse will be filtered out by the resistor-capacitor network including the resistor 221 and the capacitor 223, and the positive input of the amplifier 222 will rise, causing a corresponding rise in the output of the amplifier 222. The diode 228 will be biased on and the capacitor 237 will charge. In addition, the transistor 229 will be biased on, and the potential at junction 232 will be a function of the resistances of transistor 229 and resistor 231. The potential at the junction 232 will rise and cause a corresponding increase in the potential at the negative input of the amplifier 222. When the potential at the junction 232 rises to the level of the voltage peak of the pulse presently on the line 202, the amplifier 222 will switch and its output will become negative, thereby biasing off the diode 228. The capacitor 237 cannot, however, discharge because of the reverse bias on the diode 228 and the fact that the transistor 229 has an extremely high input impedance. Consequently, the capacitor 237 holds the charge, the transistor 229 continues to be biased on and the potential at the junction 232 will be maintained at the level of the peak of the last pulse on the line 202. The next succeeding pulse on the line 202 will be slightly higher in amplitude than the previous pulse and, therefore, the potential at the positive input of the amplifier 222 will be higher than the potential at the negative input of the amplifier 222. Consequently, the amplifier 222 will again switch and its output will become positive, the diode 228 will be biased on, the capacitor 237 will be charged to a slightly higher level, and the potential at the point 232 will increase until it is equal to the peak of this pulse at which time the amplifier 222 will switch. It will be apparent from the foregoing that the transistor 229 will be biased on to succeedingly higher levels by each incoming pulse and the potential at the junction 232 will gradually increase and be a function of the peak values of the pulses. The diode 228 may however be biased on only for a portion of the time duration of each of the incoming pulses.

To reset the peak and hold circuit 206 before the beginning of each new cycle of operation of the system, it is necessary to discharge the capacitor 237. The reset circuit 216 (FIGS. 4 and 5B) is triggered to close a relay operated switch 241 which is connected by lines 240 (FIGS. 5A and 5B) in parallel with the resistor 227 and the diode 228. The switch 241 is operated by a relay coil 242 which is momentarily energized in order to close the switch 241. When the switch 241 is closed, the capacitor 237 discharges through the resistor 236, the switch 241, and into the operational amplifier 222, and the potential at the gate of the transistor 229 falls. Before or at the beginning of a cycle of operation of the system, the output of the amplifier 222 is low, such as minus 12 volts, and the capacitor 237 is able to discharge into it. As the gate potential of the transistor 229 falls, the potential at the junction 232 also falls. When the potential at the junction 232 falls to the level where the negative input of the amplifier 222 is equal to the reference level potential at its positive input, the amplifier 222 switches and its output rises and holds its two inputs at equal values and stops further discharge of the capacitor 237.

It is preferable that the switch 241 be closed for a relatively short time, such as two milliseconds, at the beginning of each new cycle of operation in order to reset the circuit 206 as described above. While the reset circuit 216 may be a simple manually operated normally open switch and a power supply connected in series with the coil 242 as disclosed in the Bardwell et al. U.S. Pat. No. 3,926,264, it is preferred that a conventional trigger circuit be used which will momentarily energize the coil 242 at the beginning of each cycle of operation. Such a trigger circuit may be connected to one of the lines 21 as shown in FIG. 5B and be actuated to close the switch 241 in response to current flow in the lines 21 and 22 at the initiation of a cycle of operation. Where a manually operated switch is used as mentioned above, it may be a timing switch which would remain closed only for about two milliseconds when actuated and then would automatically open.

Connected between the point 232 of the peak and hold circuit 206 and its output is a buffer amplifier including an operational amplifier 238, and a resistor 239. The output of the amplifier 238 is connected to the line 34 and to another output line 243.

The torque control circuit 211 is described in detail in the previously mentioned Bardwell et al patent but will be summarized herein in connection with FIG. 5B. The peak torque signal from the output line 240 of the peak and hold circuit 206 is connected to the positive input of an operational amplifier 251. The positive input is also connected to a reference potential which, in the present instance, is formed by a resistance network including variable resistors 252 and 253 which are connected between a negative DC potential 255, such as minus 9.3 volts, and a ground line 254. The potential at the positive input of the amplifier 251 is therefore the sum of the two inputs, one on the line 240 and the other from the wiper of the resistor 252. The positive input is also connected through a pair of back-to-back diodes 256 to the ground line 254, and they maintain the positive input to within one volt of the negative input of the amplifier 251. A feedback loop including a resistor 257 is also connected between the output and the positive input of the amplifier 251.

The output line 203 from the preamplifier 201, which has the pulsating torque signal thereon, is connected to the negative input of another operational amplifier 261. A resistor 262 and a capacitor 263 are connected between the negative input and the ground line 254 serve as a filter which causes the voltage level at the negative input of the amplifier 261 to gradually increase when a torque pulse appears on the line 203 and to gradually decrease during the time interval between two pulses. A diode 264 connects the negative input of the amplifier 261 to the ground line 254, and a resistor 266 connects the negative input of the amplifier 251 to the ground line 254. The positive input of the amplifier 261 is connected to a reference potential formed by an adjustable resistance network 267 connected between a positive DC potential, such as plus 15 volts, and the ground line 254. The resistance network forms a reference voltage level on the positive input of the amplifier 261. A feedback loop including a hysteresis resistor 268 is connected between the output and the positive input of the amplifier 261, and the output of the amplifier 261 is also connected through a resistor 269 and a diode 271 to the negative input of the amplifier 251. The output signal of the circuit 211 is taken from the output of the amplifier 251.

Considering the operation of the circuit 211, the operational amplifier 261 forms a voltage level detector or comparator with the positive input having a reference potential thereon and a varying signal being connected to the negative input. The amplifier 261 switches and its output drops when the potential on the negative input equals the reference potential plus the feedback voltage through the resistor 268. The amplifier 261 also switches and its output rises when the voltage on the negative input equals the reference voltage minus the feedback voltage. The previously mentioned gradually increasing and decreasing voltage level on the negative input of the amplifier 261 causes the amplifier 261 to alternately switch between its two states and thus causes a square or rectangular voltage signal to appear at its output, as described in the Bardwell et al patent. Since the cathode of the diode 271 is connected to the output of the amplifier 261, only the negative portions of its output signal will pass to the amplifier 251, and the negative input of the amplifier 251 has a voltage thereon which varies between zero level and a negative level. Without the diodes 256, the voltage on the positive input of the amplifier 251 would start out at a low negative value and gradually increase in the positive direction as the peak torque curve on the line 243 from the peak and hold circuit 206 gradually increases. The diodes 256 however maintain the voltage on the positive input at less than minus one volt. Considering the positive input of the amplifier 251 as the reference input, the output of the amplifier 251 will switch with changes in the voltage on its negative input between zero and a low negative value, but, of course, the output of the amplifier 251 will be inverted. When the output of the amplifier 251 is at a high level, the tool is turned off as will be explained later, and when the output of the amplifier 251 is at a low level, the tool is turned on. Of course, the voltage on the positive input of the amplifier 251 also varies because it gradually increases as the peak torque signal from the output of the peak and hold circuit 206 gradually increases. When the peak torque signal is sufficiently high, the potential on the positive input of the amplifier 251 rises to between zero and plus one volt and consequently the negative input potential cannot rise above it. The output of the amplifier 251 will therefore remain high and the tool will be maintained off, until the next cycle of operation is started. The torque value at which the voltage level on the positive input of the amplifier 251 becomes positive is referred to as the preset maximum torque, and it may be adjusted using the resistor 252.

It will be apparent from the foregoing that the circuit 211 causes the tool to be pulsed on and off, and that it causes the tool to be turned off at the end of a cycle when the peak output torque rises to the preset maximum torque value.

Considering next the construction and operation of the power switch 213 and the throttle switch and throttle relay 214, the switch 214 comprises a plurality of normally open switches 281 through 284. One of the switches is associated with each of the tools 10 through 13, and in the present illustration the switch 281 is connected to control operation of the tool 10. As shown in FIG. 5B, the tool 10 includes a solenoid 286 which controls operation of an air valve in the tool 10, as previously explained, and the switch 281 is connected in one of the two lines 21 and 22 which connect the power switch 213 to the coil 286. The four switches 281 and 284 are all connected to a plunger 287 which is inductively coupled to a coil 288. The coil 288 is connected in series with a normally open manually operable switch 289, and this series combination is connected across a DC power supply. It will be apparent that when the switch 289 is manually closed, the coil 288 will be energized and the plunger 287 will move the four switches 281 to 284 to their closed positions. On the other hand, when the switch 289 is open, the four switches 281 to 284 will be open. When the switches 281 through 284 are closed, the solenoids 286 of the four tools 10 through 13 will be connected to receive energizing current from the four power switches 213 of the control circuits 23 through 26.

Considering next the operation and construction of the power switch 213, assume that the manual switch 289 has been closed and that the four switches 281 through 284 are also closed. The switch 289 must be held closed throughout a cycle of operation. Assume further that a negative signal or pulse appears at the output of the operational amplifier 251 of the torque control circuit 211. As previously explained, the existence of a negative pulse out of the circuit 211 serves to energize the tool 10. Assume still further that the comparator circuit 28 does not generate an inhibit signal and that, therefore, the potential on the line 49, which is connected to the power switch 213 is low or negative.

The power switch 213 includes a transistor 293 which has its base connected through a resistor 294 to the output of the amplifier 251. The base and emitter of the transistor 293 are connected by a diode 296 which has its anode connected to the base of the transistor 293. The emitter of the transistor 293 is connected to a power ground or reference line 295 and the collector of the transistor 293 is connected by two series connected resistors 297 and 298 to a negative DC supply 292.

During the previously assumed conditions, the base of the transistor 293 is at a low or negative value and transistor 293 is biased on. Current flows from the ground line 295, through the series connection of the transistor 293, the resistors 297 and 298 and to the negative DC source 292. The diode 296 is reverse biased and therefore does not conduct.

The juncture of the two resistors 297 and 298 is connected to the base of another transistor 300 which has its emitter connected to the base of a power transistor 301 and to a resistor 302 which is connected between the transistor 300 and the negative DC source 292. The collector of the transistor 300 is connected by a capacitor 303 to its base and the collector is also connected to the collector of the power transistor 301. The emitter of the power transistor 301 is connected to the negative DC source 292, and the collector of the transistor 301 is connected to the cathode of a diode 304 which has its anode connected to one side of the coil 286 in the tool 10 by the line 21. The anode of the diode 304 is also connected to the anode of another diode 306 which has its cathode connected to a positive DC source 307. The sources 307 and 292 may for example be plus and minus 20 volts. A resistor 308 and a coil capacitor 309 are connected in series between the positive source 307 and the negative source 292, and the juncture of the resistor 308 with the capacitor 309 is connected through the switch 281 to the other side of the coil 286.

As previously mentioned, the transistor 293 is biased on in the assumed conditions, and the transistor 293 and the two resistors 297 and 298 form a resistance network. When the transistor 293 is biased off, the base of the transistor 300 is at the level of the negative DC source 292 and it is off, but when the transistor 293 is biased on, the base of the transistor 300 rises, thereby biasing the transistor 300 on. Current then flows through the path including the positive source 307, the resistor 308, the coil 286, the diode 304, the transistor 300, and the resistor 302. Initiation of this current flow results in a rise in the potential on the emitter of the transistor 300 and on the base of the power transistor 301 which biases the transistor 301 on.

Prior to the time that the transistor 301 is biased on, the capacitor 309 is fully charged due to its connection between the negative DC source 292, the resistor 308 and the positive DC source 307. As soon as the transistor 301 is biased on, the capacitor 309 immediately starts to discharge through the circuit including the capacitor 309, the switch 281, the coil 286, the diode 304, the transistor 301 and the line leading to the negative DC source 292. The discharge of the capacitor 309 provides a substantial initial current flow through the coil 286 which very quickly opens the air valve in the tool 10. If the negative DC source 292 is at minus 20 volts and the positive DC source 307 is at a positive 20 volts, the capacitor 309 will be initially charged to a voltage of 40 volts.

With the transistor 301 biased on, a second circuit path is also completed from the positive DC source 307 through the resistor 308, the switch 281, the coil 286, the diode 304, the transistor 301 and the negative DC source 292. When the capacitor 309 has discharged to a lower level, such as plus 13 volts, it will be prevented from further discharge because of the current flow through the second circuit path, and the capacitor 307 will then remain at this level of discharge as current flows through the resistor 308, the coil 286 and the transistor 301 in order to maintain the coil 286 energized. It will be apparent therefore that the capacitor 309 provides an initial current pulse which rapidly turns on the tool 10, but after the capacitor has discharged to a certain level, the second circuit path operates to hold the solenoid 286 energized and the tool on.

At the end of a voltage peak or pulse such as one of the pulses 204 in FIG. 4, the potential at the base of the transistor 293 will rise and bias the transistor 293 off. The two transistors 300 and 301 will also be biased off, the coil 286 will be deenergized, and the tool will be turned off. During the off condition, the capacitor 309 will once again be charged to the maximum level of the potential difference between the two sources 292 and 307. In a cycle of operation, each of the pulses 204 turns the tool on until the peak torque signal 207 rises to the preset maximum torque level, at which time the tool is automatically maintained off and the operator opens the switch 289. The capacitor 237 of the peak and hold circuit 206 will maintain its charge until the reset relay 241 is energized. As previously mentioned, this may be done manually at any time before the start of the next cycle of operation, or the circuit 216 may do it automatically in response to the first current pulse on the line 21 in the next cycle of operation. The latter is preferred because it permits the connection of a meter to the output of the circuit 206 which will display the maximum torque level reached, until the beginning of the next cycle of operation.

Assume that an inhibit signal appears on the line 49 for the reason previously explained. The inhibit signal is also at a positive or high level which biases the diode 296 on. Current flows through it which biases the transistor 293 off. Consequently, the transistors 300 and 301 will also be biased off and the coil 286 will be deenergized. Therefore, during the existence of an inhibit signal on the line 49, the tool 10 will be turned off regardless of the potential appearing at the output of the amplifier 251 of the torque control circuit 211.

In the foregoing described construction, a plurality of tools are controlled by comparing the torque output of each tool with a signal representing the average torque output of all of the tools. In the construction shown in FIG. 6, an arrangement is illustrated wherein two tools are controlled and, instead of comparing the torque output of each tool with the average torque output, the torque output of each tool is compared directly with the torque output of the other tool.

Figure 6:
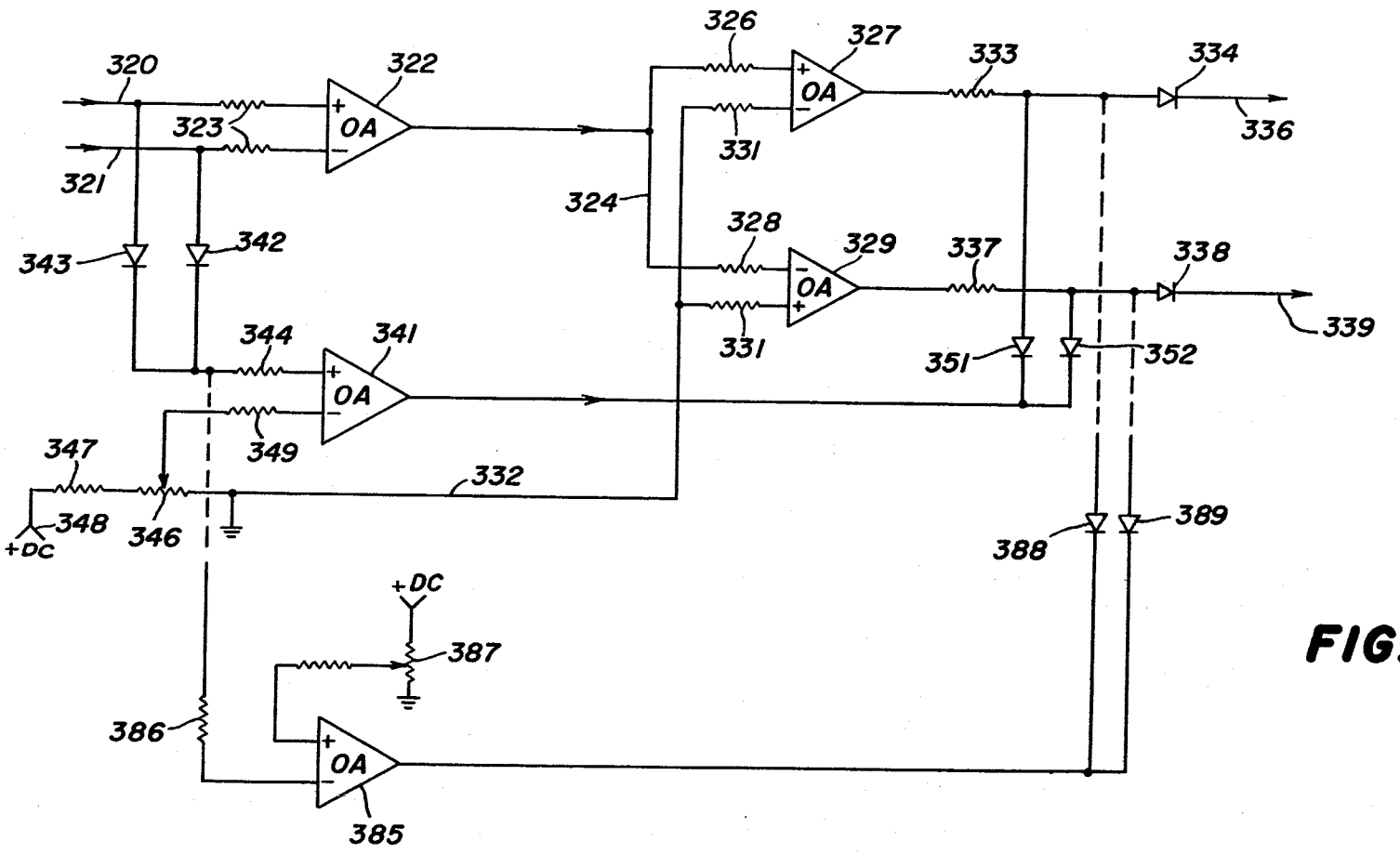
FIG. 6 is a schematic electrical diagram of an alternative construction.

With reference specifically to FIG. 6, the portion of the system is illustrated which includes a comparator circuit and a suppressor circuit. A complete system would also include a pair of tools, such as the tools 10 and 11, and unit control circuits, such as the circuits 23 and 24. The circuit shown in FIG. 6 includes two input lines 320 and 321 which are connected to receive the peak torque signals such as the signals appearing on the lines 34 and 35 of FIG. 1. The lines 320 and 321 are respectively connected to the positive and negative inputs of an operational amplifier 322, through resistors 323. The output of the amplifier 322 is connected to a line 324 which leads through a resistor 326 to the positive input of an operational amplifier 327 and also through a resistor 328 to the negative input of another operational amplifier 329. The negative input of the amplifier 327 and the positive input of the amplifier 329 are connected through resistors 331 to a reference or ground line 332.

The three operational amplifiers 322, 327 and 329 operate as potential comparator circuits. When the system is in operation peak torque signals appear on the lines 320 and 321. If the potential on the line 320 is slightly higher than the potential on line 321, for example, the higher potential at the positive input of the amplifier 322 will cause a high or positive signal to appear at its output. This high signal appears on the line 324 and at the positive input of the amplifier 327 and at the negative input of the amplifier 329. The high or positive signal has a higher level than the reference or ground potential 332, and consequently the output of the amplifier 327 will be high and the output of the amplifier 329 will be low. The output of the amplifier 327 is connected through a resistor 333 and a diode 334 to a line 336 which corresponds to the line 49 in FIG. 1, for example. When the signal output of the amplifier 327 is high, the diode 334 is biased on and the positive voltage acts as an inhibit signal which prevents the control circuit from turning on the associated tool as previously explained. The output of the amplifier 329 is connected by another resistor 337 and a diode 338 to an output line 339 which may correspond, for example, to the line 50. When the output of the amplifier 329 is low in the situation being assumed, the diode 338 will be biased off and a low signal will appear on the line 339 which will enable the associated control circuit, such as the circuit 24, to operate normally.

The lines 320 and 336 are connected to one unit and the lines 321 and 339 are connected to the other unit. Since the high signal on the line 336 prevents the associated control circuit and tool from operating, the peak torque signal on the line 320 will not rise but the peak torque signal on the line 321 will continue to increase because the control circuit and the tool connected to the line 339 will continue to operate. When the peak torque signal on the line 321 rises to a level which is above the potential on the line 320, the output of the amplifier 322 will switch and its output will become low. This causes the amplifiers 327 and 329 also to switch and the output on the line 336 to become low and the output on the line 339 to become high. Consequently, the control circuit and tool connected to the line 336 will be turned on while the control circuit and the tool connected to the line 339 will be turned off.

It will be apparent from the foregoing that the two control circuits and tools will be alternately turned on for short periods of time but will be maintained by the circuit shown in FIG. 6 to within very close peak torque output levels.

As previously explained, it is desirable to prevent the central control circuit from generating inhibit signals when the system is initially turned on, and in the system shown in FIG. 1 a suppressor circuit 33 is provided for this purpose. The circuit shown in FIG. 6 also includes a suppressor circuit comprising an operational amplifier 341 which has its positive input connected to the two lines 320 and 321. A diode 342 and a resistor 344 are connected between the line 321 and the positive input of the amplifier 341, and another diode 343 connects the line 320 with the resistor 344. The negative input of the amplifier 341 is connected to a reference voltage level which is provided by a resistance network including a variable resistor 346 and a fixed resistor 347 which are connected between a positive DC supply 348 and the ground line 332. A fixed resistor 349 connects the negative input of the amplifier 341 to the wiper of the variable resistor 346. The anodes of the two diodes 342 and 343 are connected to the two lines 321 and 320, respectively. The output of the amplifier 341 is connected by two diodes 351 and 352 to the outputs of the amplifiers 327 and 329, respectively. The output of the amplifier 341 is connected to the cathodes of the two diodes 351 and 352.

At a start of a cycle of operation of the system, the signals appearing on the two lines 320 and 321 will be relatively low and they will both be lower than the reference potential on the negative input of the amplifier 341. Since the signal on the positive input of the amplifier 341 is relatively low, the output of the amplifier 341 will be low also. Consequently, if a high signal appears at the output of either of the two amplifiers 327 or 329, which would normally serve as an inhibit signal and prevent the system from operating, the current from the output of the high amplifier will be drained through the associated diode 351 or 352 and to the low output of the amplifier 341. Consequently, the two amplifiers 327 and 329 will be prevented from providing a high or inhibit signal on the output lines 336 and 339. Thus, the low output of the amplifier 341 serves as a suppressor or disabling signal which prevents the two comparator circuits 327 and 329 from forming inhibit signals on the lines 336 and 339.

After the system has operated for a short time and as soon as the potential on either of the two lines 320 and 321 rises to the level of the reference potential on the negative input of the amplifier 341, the output of the amplifier 341 will switch to a high value and the two diodes 351 and 352 will be reverse biased, and the system will then operate normally as previously explained.

In the foregoing described arrangements, a control circuit for each tool turns on the tool and a central control circuit prevents one or more tools from applying a substantially higher torque level than the other tools. While it is not essential, a suppressor circuit is preferably included to disable the central control system until a low or minimum torque level has been reached by all of the tools. Each tool is turned off at the end of a cycle when a preselected maximum torque level has been reached.

Figure 7:
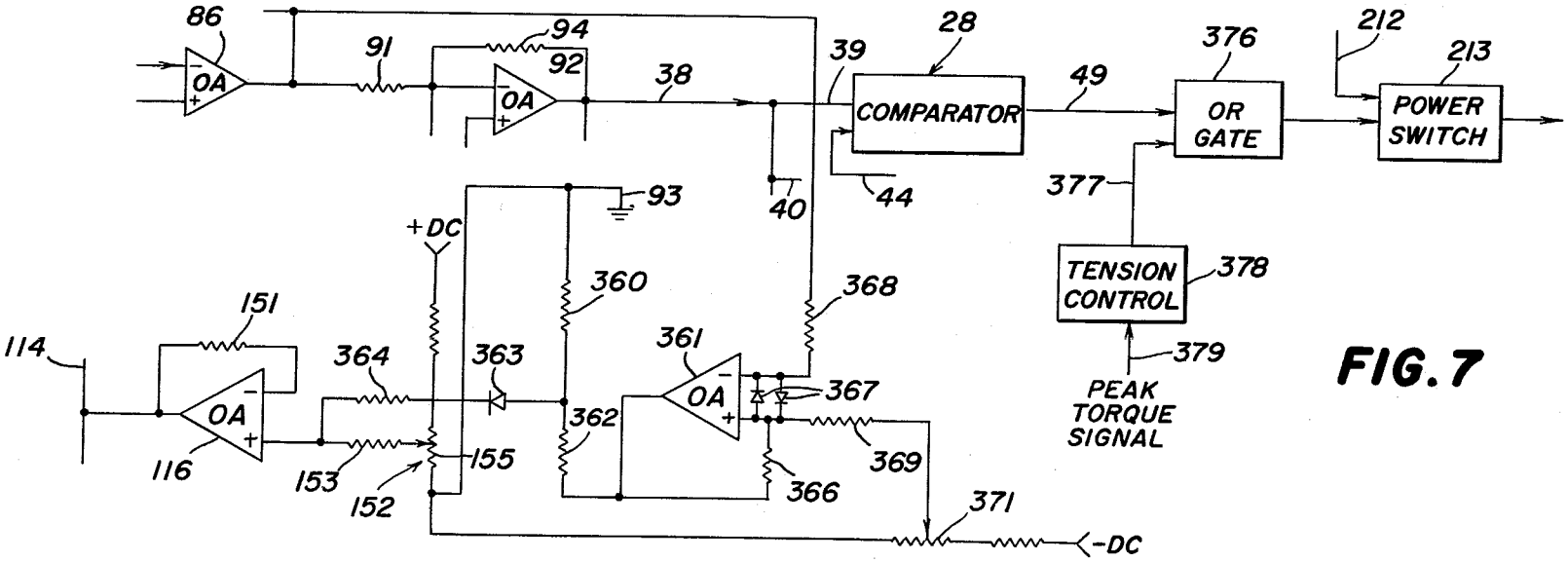
FIG. 7 is a schematic electrical diagram of another alternative construction.

In some circumstances it is desirable to turn each tool off in response to a factor other than the attainment of a maximum torque level but to have the system operate as described above until the maximum torque level has been reached. A modified system is illustrated in FIG. 7 wherein each tool is turned off at the end of a cycle by the attainment of a preselected amount of tension in a fastener. The modified system utilizes all of the components of the system illustrated in FIGS. 1 to 5, and some of the components, which have been given the same reference numerals, are included in FIG. 7 to illustrate the connections of the modified circuit.

In the suppressor 32, the low level reference potential on the line 114 is preset by an adjustment of the potentiometer 155. As previously mentioned, where the maximum voltage of the peak torque signals on the lines 34 to 37 is plus 5 volts, the low level reference potential on the line 114 is approximately plus 1 to 2 volts. It is important to keep in mind that the suppressor circuit 33 generates a disabling signal when the potential on the line 114 is higher than the potential on any of the lines 34 to 37.

The modified system includes means for increasing the reference potential on the line 114 to a higher level, such as plus 7 volts, and thereby again generating a disabling signal at an upper applied torque level.

The modified circuit includes an operational amplifier 361 connected as a voltage comparator. The output of the amplifier 361 is connected through a resistor 362, a diode 363 and a resistor 364 to the positive input of the amplifier 116. The juncture of the resistor 362 and the diode 363 is connected to the ground line 93 by a resistor 360. The amplifier 361 output is also connected by a resistor 366 to its positive input to form a feedback loop.

The two inputs of the amplifier 361 are connected by two back-to-back diodes 367, and the negative input is connected by a line 368 to the output of the amplifier 86. Thus, the negative input receives the average torque signal produced by the amplifier 86. The positive input is connected by a fixed resistor 369 to a variable resistor 371 which is connected in a resistance network that produces a reference potential. The variable resistor 371 is connected in series with the variable resistor 155 and across a power supply.

In the system illustrated in FIGS. 1 and 4, the line 49 which carries the inhibit signals is connected directly to the power switch 213 of the unit control circuit 23. In the modified circuit of FIG. 7, an OR gate 376 is connected between the comparator 28 and the power switch 213. The OR gate 276 has one input connected to the line 49 and a second input 377 which is connected to the output of a tension control circuit 378. A line 379 feeds the peak torque signal of this unit to the control circuit 378. The power switch 213 receives the output of the OR gate 376 and the output on the line 212 of the torque control circuit 211. The signal on the line 212 causes the tool to be turned on and off in a pulsating mode of operation as previously explained. The potentiometer 252 (FIG. 5B) is however preadjusted to produce a very low negative potential on the positive input of the amplifier 251 so that this input will always be negative and the circuit 211 cannot turn this tool off when a maximum torque level is reached. Instead, the tension control circuit 378 senses the amount of tension in the fastener and generates a pulse at a preset tension level which pulse passes through the OR gate 376 and turns off the tool at the end of a cycle.

At the beginning of a cycle of operation, the voltage out of the amplifier 86 is the inverse average signal and will be, for example, minus 1 volt which will appear at the negative input of the amplifier 361. The potentiometer 371 is adjusted to produce a potential of, for example minus 4.5 volts on the positive input. The negative input will be at a higher potential and therefore the amplifier 361 output will be negative. The diode 363 will be reverse biased and therefore the potential on the positive input of the amplifier 116 will be controlled by the setting of the potentiometer 155. The suppressor circuit will operate as explained in connection with FIG. 3A and produce a disabling signal until a minimum torque level is reached. After this disabling signal is withdrawn, the comparator circuits 28 to 31 operate to produce inhibit signals as previously explained.

As the fasteners are tightened, the inverse average signal on the line 368 becomes increasingly negative, and when it reaches the level on the positive input, the amplifier 361 switches and its output becomes positive. The potentiometer is preferably adjusted so that this occurs at approximately the torque level where the circuit 211 turns off the tool to end a cycle. The diode 363 is biased on, and the resistors 360 and 362 form a voltage divider network which places a relatively high potential on the positive input of the amplifier 116. This high potential should be higher than the maximum peak torque signals on the lines 34 to 37, and may for example be plus seven volts where the maximum torque signal is plus 5 volts. This high potential on the positive input of the amplifier 116 drives the potential on the line 114 to a correspondingly high level which is higher than the peak torque signals. Consequently, the suppressor circuit again generates a disabling signal which prevents the circuits 28 to 31 from generating inhibit signals. It was previously mentioned that the potentiometer 252 is set so that the circuit 211 cannot turn the tool off. Consequently each unit continues to tighten its fastener until the tension control circuit 378 senses a preselected tension level in the fastener and turns off the tool to end a cycle. Thus the central control circuit provides a uniform torque output from all of the units until a relatively high torque output level is reached. The central control circuit is then disabled and the tension control circuits of the units take over control.

While various tension control circuits may be used, it is preferred that a circuit be used of the character disclosed in applicant's U.S. patent application Ser. No. 663,678, filed Mar. 4, 1976.

The two unit circuit illustrated in FIG. 6 may also be used in combination with a tension responsive turn off system. Such an arrangement is illustrated in FIG. 6 and the connections to the previously described circuit are shown by dashed lines. It includes a high level operational amplifier 385 connected as a voltage comparator, the negative input being connected through a resistor 386 to the cathodes of the two diodes 342 and 343, and the positive input being connected to a reference voltage. A variable resistor 387 similar to the resistor 346, connected between a positive potential source and ground may be used. The output of the high level amplifier 385 is to be connected by two diodes 388 and 389 to the anodes of the two diodes 334 and 338. The connections and polarities of the diodes 388 and 389 is the same as for the diodes 351 and 352. It will be apparent that such an arrangement is the same as for the low level suppressor circuit, except that the inputs to the high level amplifier 385 are reversed with respect to the connections to the low level amplifier 341. Further, the reference potentials are different.

As a specific example, if the maximum voltage out of the torque transducers in the tools is plus 5 volts, the tension control circuit (not shown in FIG. 6) of each tool may be adjusted to turn off the tool and terminate a cycle when a transducer output reaches plus 4 volts. The resistor 346 may be adjusted to provide a reference potential of plus 1 volt on the negative input of the low level amplifier 341 and the corresponding resistor 387 may be adjusted to provide a reference potential of plus 3 volts on the positive input of the high level amplifier 385.

At start up, the low level amplifier 341 provides a negative suppressor signal as previously described and the high level amplifier 385 would provide a high or positive signal. At intermediate torque outputs, both amplifiers 341 and 385 would provide high outputs. At a high torque output signal of above 3 volts, the high level amplifier 385 would provide a negative suppressor signal to block the inhibit signals. The tension control circuit would terminate the cycle as described in connection with FIG. 7.

The circuits disclosed herein would of course also require a power supply and power connections including a power ground. A conventional regulated DC supply producing plus and minus 20 volts and 15 volts may be used. Since such a power supply and the connections are conventional and obvious, they are not all illustrated in order to simplify the drawings.

I claim:

1. A central control circuit for use in a machine having a plurality of torque applying units, comprising comparator means responsive to the torque output of each of said units and responsive to a torque comparison value, said comparison value being a function of the instantaneous torque output of at least one of said units and increasing as said instantaneous torque output increases, said comparator means comparing said torque output of each unit with said comparison value and preventing operation of a unit having a torque output which is greater than said torque comparison value.

2. A central control circuit for use in a machine having a plurality of torque applying units, comprising comparator means responsive to the torque output of each of said units and responsive to a torque comparison value, said comparator means comparing said torque output of each unit with said comparison value and preventing operation of a unit having a torque output which is greater than said torque comparison value, said central control circuit further including averaging means responsive to the torque outputs of all said units and providing an average value of said torque outputs, said average value forming said comparison value.

3. A circuit according to claim 2, wherein said averaging means includes an adjustment for selectively making said average value greater or less than the actual average torque output or exactly equal to the actual average torque output.

4. A central control circuit for use in a machine having a plurality of torque applying units, comprising comparator means responsive to the torque output of each of said units and responsive to a torque comparison value, said comparator means comparing said torque output of each unit with said comparison value and preventing operation of a unit having a torque output which is greater than said torque comparison value, said machine including only two of said units, and said comparator means receiving said torque outputs of both of said units and comparing said torque outputs, whereby said comparison value comprises one of said torque outputs.

5. A central control circuit for use in a machine having a plurality of torque applying units, comprising comparator means responsive to the torque output of each of said units and responsive to a torque comparison value, said comparator means comparing said torque output of each unit with said comparison value and preventing operation of a unit having a torque output which is greater than said torque comparison value, said central control circuit further including suppressor circuit means adapted to receive said torque outputs, said suppressor circuit means comparing said torque outputs with a low level torque reference value and preventing said comparator means from operating when all of said torque outputs are less than said low level torque reference value.

6. A circuit according to claim 5, wherein said machine includes at least three of said units, and said suppressor circuit means prevents said comparator means from operating when said torque output of any unit is less than said low level torque reference value.

7. A circuit according to claim 5, wherein said machine includes only two of said units, and said suppressor circuit means prevents said comparator means from operating only when both torque outputs are less than said low level torque reference value.

8. A circuit according to claim 5, wherein said suppressor circuit means further includes high torque level responsive means for preventing said comparator means from operating when said torque outputs of said units are above a high torque reference value.

9. A circuit according to claim 8, and further including tension level responsive means for each of said units for turning off said units.

10. A machine comprising a plurality of torque applying units, each of said units including a unit control circuit, said machine further including central control circuit means responsive to the torque outputs of said units, said central control circuit means including comparator means for comparing the torque output of each of said units with the torque outputs of the other of said units, said comparator means operating continuously as the torque outputs increase from a low level of torque up to a high level of torque and preventing one unit from operating when said one unit applies greater torque than the other of said units.

11. A machine according to claim 10, wherein said machine includes two of said units, and said comparator means compares said torque output of one of said units with the torque output of the other of said units and prevents operation of the one unit which applies greater torque than the other of said units.

12. A machine according to claim 10, wherein said machine includes at least three of said units, and said central control circuit means further includes averager circuit means connected to receive said torque outputs and to provide a comparison value which is a function of the average of said torque outputs, said comparator means comparing said comparison value with each of said torque outputs and preventing operation of one or more of said units when the torque output thereof is greater than said comparison value.

13. A machine according to claim 10, wherein said central control circuit means further includes suppressor circuit means responsive to said torque outputs and to a low level torque value for preventing operation of said comparator means while said torque outputs are less than said low level torque value.

14. A machine comprising a plurality of torque applying units, each of said units including torque sensing means providing a torque output which is representative of the torque applied by said unit, and torque control circuit means connected to receive said torque output and connected to control energization of said unit, said machine further including central control circuit means connected to receive said torque output from each of said units, said central control circuit means comprising comparator means for comparing said torque output of each unit with a comparison value and preventing a unit from operating when the torque thereof is greater than said comparison value, said comparison value increasing as the torque outputs of said units increase.

15. In a machine including a plurality of torque applying tool units, each of said units including torque output sensing means for indicating the torque output of said unit, the improvement comprising a central control circuit connected to receive all of said torque outputs, said central control circuit comprising comparator means for comparing each of said torque outputs with a torque comparison value and being connected to prevent a particular unit from operating when said torque output of a particular unit represents a torque greater than the torque represented by said torque comparison value, said comparison value increasing as the torque outputs of said units increase.

16. In a machine including a plurality of torque applying tool units, each of said units including torque output sensing means for indicating the torque output of said unit, the improvement comprising a central control circuit connected to receive all of said torque outputs, said central control circuit comprising comparator means for comparing each of said torque outputs with a torque comparison value and being connected to prevent a particular unit from operating when said torque output of a particular unit represents a torque greater than the torque represented by said torque comparison value, said central control circuit further including averager means for providing an average torque value which is a function of the average of all of said torque outputs, and said torque comparison value consisting of said average torque value.

17. In a machine including a plurality of torque applying tool units, each of said units including torque output sensing means for indicating the torque output of said unit, the improvement comprising a central control circuit connected to receive all of said torque outputs, said central control circuit comprising comparator means for comparing each of said torque outputs with a torque comparison value and being connected to prevent a particular unit from operating when said torque output of a particular unit represents a torque greater than the torque represented by said torque comparison value, said machine including only two of said units, and said torque comparison value consisting of said torque output of one of said units.

18. In a machine including a plurality of torque applying tool units, each of said units including torque output sensing means for indicating the torque output of said unit, the improvement comprising a central control circuit connected to receive all of said torque outputs, said central control circuit comprising comparator means for comparing each of said torque outputs with a torque comparison value and being connected to prevent a particular unit from operating when said torque output of a particular unit represents a torque greater than the torque represented by said torque comparison value, said central control circuit further comprising a suppressor circuit including means for generating a torque reference level value, said suppressor circuit being connected to receive said torque outputs from said units, said suppressor circuit further including comparison means for comparing said torque reference level value with each of said torque outputs and disabling said comparison means when said torque reference level value is greater than said torque outputs.

19. Apparatus according to claim 18, wherein said suppressor circuit further includes means responsive to said torque outputs and generating a torque reference level having a relatively high value only after said torque outputs have risen to a relatively high value.

20. Apparatus according to claim 15, wherein said tool units are adapted to apply torque to fasteners, and further including in each of said units means responsive to the tension in the fastener associated with the unit, said tension responsive means turning off said unit when said tension reaches a preselected level.

21. In a machine including a plurality of torque applying tool units, each of said units including torque output sensing means for indicating the torque output of said unit, the improvement comprising a central control circuit connected to receive all of said torque outputs, said central control circuit comprising comparator means for comparing each of said torque outputs with a torque comparison value and being connected to prevent a particular unit from operating when said torque output of a particular unit represents a torque greater than the torque represented by said torque comparison value, said tool units being adapted to apply torque to fasteners, and further including in each of said units means responsive to the tension in the fastener associated with the unit, said tension responsive means turning off said unit when said tension reaches a preselected level, said central control circuit further includes suppressor means for preventing operation of said comparator means after said torque comparison value reaches a preselected upper level.

22. Apparatus according to claim 21, wherein said suppressor means further prevents operation of said comparator means when said torque outputs are below a preselected lower level.

23. A method of controlling a machine having a plurality of torque applying units, comprising the steps of sensing the torque output of each of said units, comparing the torque of each unit with a torque comparison signal to identify a unit which is applying more torque than the other unit or units, said comparison signal being a function of the instantaneous torque output of at least one of the units and increasing as said instantaneous torque output increases and preventing such an identified unit from operating until said other unit or units have essentially the same torque output as said identified unit.

24. A system for controlling the torque output of a plurality of torque applying units, each of said units including a drive motor, a unit control circuit for controlling energization of said drive motor, and torque sensing means for generating a unit torque signal representing the torque output of said unit, said system comprising an averager circuit adapted to receive said unit torque signals and to generate an average torque signal which is a function of the average of all of said unit torque signals, and a comparator circuit for each of said units, each of said comparator circuits being connected to receive said average torque signal and the unit torque signal of the associated unit and to generate an inhibit signal when the unit torque signal is greater than said average torque signal, each of said comparator circuits being connected to feed said inhibit signal to the associated unit control circuit, and each unit control circuit being prevented from energizing said drive motor during the presence of an inhibit signal.

25. A system according to claim 24, wherein each of said comparator circuits comprises an operational amplifier connected to receive average torque signal and a unit torque signal, and having a hysterisis resistor connected between its output and one of its inputs.

26. A system according to claim 24, and further including a gate connected between said averager circuit and said comparator circuits, and a suppressor circuit connected to receive said unit torque signals, said suppressor circuit including means for comparing said unit torque signals with a preset low torque reference level and generating a disabling signal when said torque signals are lower than said reference level, said gate being responsive to said disabling signal and blocking the flow of said average torque signal to said comparator circuit in the presence of said disabling signal.

27. A system according to claim 26, and further including means responsive to said disabling signal for supplying a relatively high, reference level to said comparators while said gate blocks said average torque signal.

28. A system according to claim 27, and further including means responsive to said average torque signal for increasing the value of said torque reference level when said average torque signal reaches a relatively high value.

29. A system according to claim 26, wherein said suppressor circuit includes means for generating said torque reference level, a comparator circuit connected to receive each of said unit torque signals and said torque reference signal, and a NAND gate connected to the outputs of said last named comparator circuits.

30. A system for controlling the torque outputs of two torque applying units, each of said units including a drive motor, a unit control circuit and torque responsive means for generating a unit torque signal representative of the torque output, said system comprising a comparator circuit connected to receive the two unit torque signals and generating a control signal which is indicative of which unit is producing the higher torque, and gate means connected to receive said control signal and generating an inhibit signal which is fed to the unit control circuit of the unit producing the higher torque.

31. A system according to claim 30, and further including suppressor circuit means connected to receive said unit torque signals and a torque reference level, said suppressor circuit means also being connected to the outputs of said gate means said suppressor circuit preventing the flow of inhibit signals while both of said unit torque signals are lower than said torque reference level.

* * * * *